US006782576B1

(12) United States Patent
Valencic et al.

(10) Patent No.: US 6,782,576 B1
(45) Date of Patent: Aug. 31, 2004

(54) SURVIVAL TOOL

(76) Inventors: Michael Valencic, 212 Altermoor Dr., Natrona Heights, PA (US) 15065; David Valencic, 212 Altermoor Dr., Natrona Heights, PA (US) 15065

( * ) Notice: Subject to any disclaimer, the term of this patent is extended or adjusted under 35 U.S.C. 154(b) by 191 days.

(21) Appl. No.: 10/368,250

(22) Filed: Feb. 18, 2003

(51) Int. Cl.[7] ..... B23B 11/00
(52) U.S. Cl. ..... 7/158; 7/170
(58) Field of Search ..... 7/158, 169, 100, 7/170

(56) References Cited

U.S. PATENT DOCUMENTS 4,363,147 A * 12/1982 Deweese ..... 7/158
4,672,745 A * 6/1987 Wilkens ..... 30/340
5,313,376 A * 5/1994 McIntosh ..... 362/119
5,642,567 A * 7/1997 Lin ..... 30/366

* cited by examiner

*Primary Examiner*—Hadi Shakeri
(74) *Attorney, Agent, or Firm*—David Valencic

(57) ABSTRACT

A multi-function utility and survival tool, which incorporates a whistle, flint rock fire starter, an alumina-rod blade sharpening device, a honing stone, a glass shattering device, and a light reflecting signal device. All individual elements of this tool are combined into a single unit making it practical and convenient to use.

12 Claims, 2 Drawing Sheets

SURVIVAL TOOL

BACKGROUND OF THE INVENTION

Field of Endeavor

This invention relates to the sporting goods industry, and more specifically to a multi-function survival tool. A single unit comprising of a whistle, fire starter, blade sharpener, hook sharpener, signal mirror, and a glass-shattering device.

Currently, these items can be found in the market place as individual items. Although each of these items provides a useful purpose, alone they do not cover the many needs one may encounter in a survival situation. On a practical level, it would be too cumbersome to carry all of these items individually. By combining the above mentioned items into one multi-function tool, a convenient, practical tool can be utilized in the home, car, and virtually any outdoor activity. It can be used not only as a handy tool for everyday use, but also as a life saving device in a survival situation.

BRIEF SUMMARY OF THE INVENTION

A multi-function general purpose utility and survival tool, which includes a three-chamber whistle, a flint rock fire starter, an alumina-rod style blade sharpener, an alumina honing stone, a hardened glass shattering device, and a signal mirror made of high-polished stainless steel.

A principle object and advantage of this device is a convenient and practical tool, which provides multiple functions as an aid to many sporting activities.

Another object and advantage of this device is the practical advantage of having several potential life saving features combined into a single unit, a necessity in a survival situation.

Other objects and advantages of this device will become readily apparent upon review of the following figures, specifications, and appended claims.

DETAILED DESCRIPTION OF THE INVENTION

Figure 1:
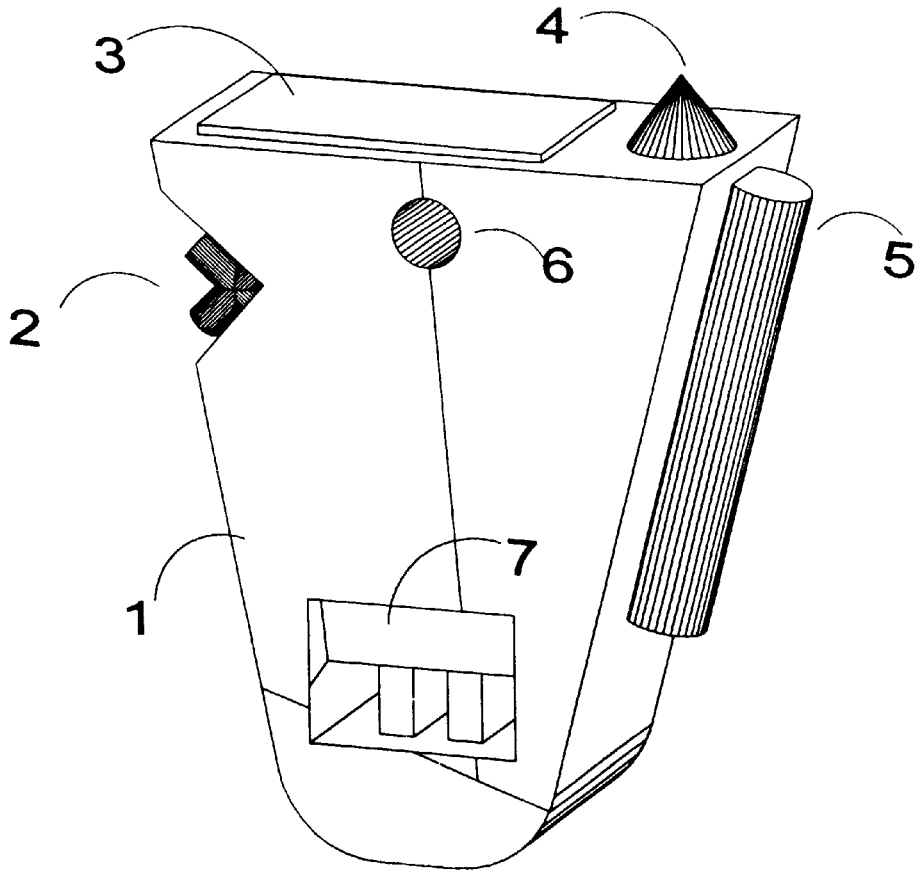
FIG. 1 is a perspective view of the six in one multiple function survival tool. Each separate function of the tool is shown except the light reflecting signal device which is located on the back of the unit
Figure 3:
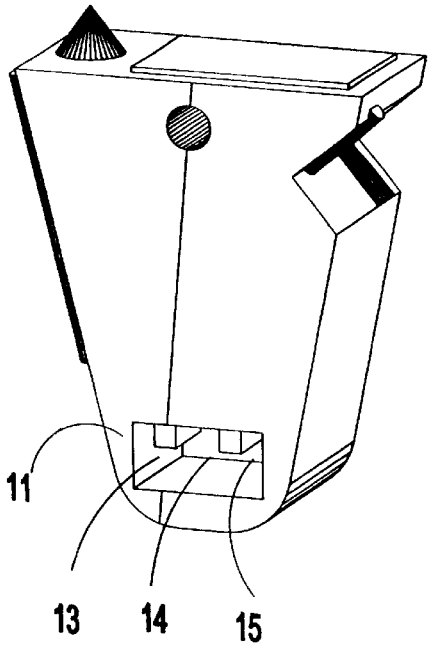
FIGS. 2–4 are perspective views showing the light reflecting signal device, the back of the tool where the light reflecting signal device will be mounted, the whistle air chambers, and the whistle air compressor device.
Figure 4:
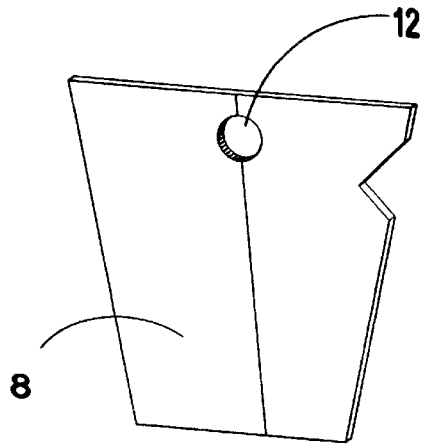

Referring to FIG. 1, this multiple function survival tool 1, were each function works independently from each other, is triangular in shape measuring two and one half inches high, two inches wide at the top of the triangle, one inch wide at the whistle opening part of the triangle, the body of the survival tool is one half of an inch deep.

Located in the upper left quadrant as viewed from the front FIG. 1, is the edge-sharpening tool 2. The sharpening stones are three quarter inches long by one eighth cylinder shaped Alumina Rod embedded into the body of the tool. The sharpening stones form a cutting angle of twenty-two degrees per side. The object being sharpened can be pulled through the "V" shape of the stones or the item being sharpened can be secured in its position and the "V" shaped sharpening stones dragged over the edge of the item being sharpened. The sharpening stones can be rotated or replaced as they become worn.

The two-inch wide top portion of the triangle has an embedded flat sharpening stone 3 and a hardened point 4. The Alumina rectangle sharpening stone 3 is glued into a recessed section of the survival tool. The stone 3 measures one inch long, one half of an inch wide, one eighth of an inch deep. This flat sharpening stone can be used for multiple purpose sharpening. Fishing hooks and edges of a cutting design can be sharpened on this stone. The hardened point 4 located adjacent to stone 3, to be used in an emergency situation where an escape route may be impeded by window glass. The body of the survival tool is grasped in either hand with the hardened point 4 facing away from the little finger. A firm fast hard strike of the point impacting on the surface of the glass will cause the glass to break providing the trapped individual an escape route to safety. The hardened point 4 base diameter will not exceed the depth of the survival tool, one half of an inch, and will not exceed three quarters of an inch high. Hardened point 4, is attached to the body of the survival tool via embedded threaded insert.

Flint rock 5 is a two inch by five sixteenth cylinder located on the right side of the survival tool as viewed in FIG. 1. Flint rock 5 is attached by glue into a concave cylinder shaped groove on the side of the survival tool 1. Scraping the flint rock 5 with a corner edge made of steel will cause the flint to spark enabling the user to start a fire. Upon gathering dried grass and leaves, point 4 is to be placed into the center of the material to be ignited. Point 4 aligns the flint rock 5 with the combustible material. While holding the tool firmly in hand the flint rock is scrapped with the edge of a steel object causing the flint to spark igniting the material to start a fire.

Hole 6 measures three sixteenth in diameter and is centered one quarter of an inch below the top section of the survival tool. Hole 6 allows the use of a lanyard for securing accessories to the survival tool. The whistle 7 is incorporated into the body of the survival tool. Whistle 7 consists of three air chambers.

Figure 2:
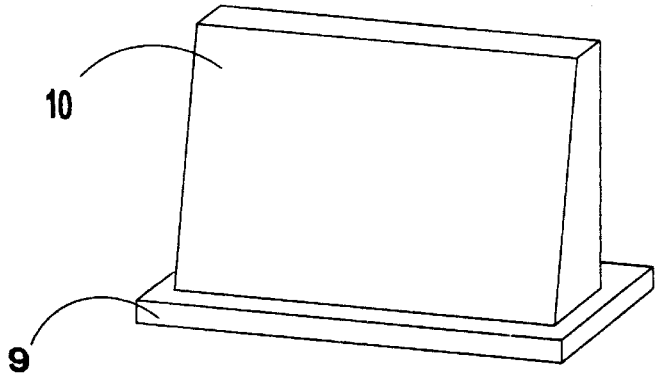

Referring to FIG. 2—air chambers 13, 14, 15 all have equal diameters of five sixteenth on an inch. Air chambers 13, 14, 15 vary in length and no two chambers will be of equal length. The middle air chamber 14 will remain the shortest, measuring one and one half inches in length. Air chamber 13, left side of middle as viewed in FIG. 2, is the second longest, measuring one and three quarter inches in length. Air chamber 15, right side of middle as viewed in FIG. 2, is longest, measuring two inches in length. These air chambers 13, 14, 15 resemble the pipes of a musical organ each generating a different tone. As the whistle is being used three different tones are being generated, independently of each other, merge together to form a unique oscillating harmony.

Again referring to FIG. 2 a high polished stainless steel light reflecting signal device 8, is attached to the back of the survival tool. The light reflecting signal device 8, has a hole 12 that overlays hole 6, FIG. 1 on the survival tool 1. and corresponds with the basic shape of the survival tool.

The whistle air compressor 9 is glued into a recessed hole 11 located on the backside of the whistle. The wedge 10 of whistle air compressor 9 forces the incoming air into the whistle air chambers 13, 14, 15, FIG. 2 with increased velocities and pressure to create the whistle tone. Wedge 10 measures one and one sixteenth long, has a height of one quarter of an inch, depth is one eighth of an inch at the base and one sixteenth of an inch at the top. Wedge 10 is manufactured off center of base eliminating improper installation of the part into the body of the survival tool during assembly.

The body of survival tool FIG. 1, the air compressor 9, FIG. 2 are made of high impact plastic.

What is claimed is:

1. A survival tool, comprising: a substantially V-shaped body having a top surface, two sides, a lower portion and a back surface; a chambered whistle incorporated in said lower portion; a Flint metal fire starter being attached to one of said sides; a glass shattering device provided on said top surface; an alumina rod blade sharpener fixed on the other one of said sides; an alumina honing stone imbedded into said top surface adjacent to said glass shattering device; and a light reflecting signal device being attached to said back surface.

2. The tool of claim 1, wherein the whistle includes chambers varying in length to create different tones blending into a unique oscillating harmony.

3. The tool of claim 2, wherein the whistle further includes a wedge shaped air compressor forcing air into the chambers.

4. The tool of claim 1, wherein the metal fire starter comprises an element that generates a hot spark sufficient to cause a flame when scraped with a hard object.

5. The tool of claim 1, wherein the glass shattering device comprises of a conical shaped hardened metal tip imbedded within the body of the tool, used to break or shatter glass by striking the tip against and perpendicular to said glass.

6. The tool of claim 1, wherein the alumina rod blade sharpener comprises a blade sharpener, said rods being imbedded into body forming a V-shape to create a cutting angle of 22 degrees per side.

7. The tool of claim 6, wherein said rods are positioned in the body to provide safety to the user while sharpening a cutting edge.

8. The tool of claim 1, wherein the honing stone is imbedded into the body of the tool to provide ease in sharpening pointed objects.

9. The tool of claim 1,wherein the rod blade sharpener and the honing stone are made from materials selected from the group including alumina, carbide, diamond.

10. The tool of claim 1, wherein a light reflecting signal device is a high polished stainless-steel surface to reflect light and direct it to a specific location as to signal or attract attention.

11. The tool of claim 10, wherein reflective surface includes a hole overlaying another hole in the body used as a peep sight to direct the reflected light toward said location.

12. The tool of claim 1, wherein the body is made of plastic.

* * * * *